United States Patent [19]

Coppelman

[11] 4,203,593

[45] May 20, 1980

[54] WORK TABLE FOR OCCUPATIONAL THERAPY

[76] Inventor: Marcy Coppelman, 185 Evelyn Rd., Needham, Mass. 02194

[21] Appl. No.: 903,490

[22] Filed: May 8, 1978

[51] Int. Cl.[2] ..... A63B 21/06

[52] U.S. Cl. ..... 272/117; 272/DIG. 4

[58] Field of Search ..... 272/117, 135, 134, 138, 272/141, 142, 143, 144, DIG. 4, 900, 67; 128/25 R; 211/69.1; 5/63

[56] References Cited

U.S. PATENT DOCUMENTS

| | | | |
|---|---|---|---|
| 2,589,812 | 3/1952 | Hoskins | 35/24 R |
| 2,960,986 | 11/1960 | Gibbons | 272/117 X |
| 3,397,411 | 8/1968 | Rossi | 5/63 X |
| 3,787,049 | 1/1974 | Rellinger | 272/144 |
| 3,851,874 | 12/1974 | Wilkin | 128/25 R |
| 4,098,502 | 7/1978 | Faust | 272/144 |

FOREIGN PATENT DOCUMENTS

| | | | |
|---|---|---|---|
| 85200 | 8/1921 | Austria | 211/69.5 |
| 484725 | 10/1929 | Fed. Rep. of Germany | 211/69.5 |

*Primary Examiner*—William R. Browne
*Attorney, Agent, or Firm*—Robert T. Gammons

[57] ABSTRACT

A work table for use in occupational therapy comprising a table top supported on a platform for adjustment of its working surface from a horizontal to an angular position relative to the horizontal, one or more flexible cords entrained about pulleys rotatably mounted at the far or upper edge of the table top with respect to a person using the same with one end resting on the surface of the table top and the other end hanging downwardly from the table top over the pulley, with implement holders attached to the ends resting on the table top and weights or springs attached to the overhanging portions of the cords.

10 Claims, 4 Drawing Figures

WORK TABLE FOR OCCUPATIONAL THERAPY

BACKGROUND OF THE INVENTION

Conventional flat top tables together with such implements as pencils, pens, punches, rulers, angles and the like are used in occupational therapy treatments to strengthen and restore response to the muscles of arms, hands and fingers of patients whose muscular control has been damaged. Unfortunately, however, the patient, in many instances, compensates for his weakness or uncoordinated muscular condition by resting his arms on the table, thus negating the effectiveness of the exercise. It is the purpose of this invention to provide a work table which can be used for occupational therapy which will discourage leaning on it for support and will require that the implements used by the patient be grasped and manipulated and further to provide for graduated degrees of resistance to manipulation of the implements as the patient's strength improves to augment such improvement.

SUMMARY OF THE INVENTION

As herein illustrated, the work table comprises a table top pivotally supported at one edge for angular adjustment of its working surface about a horizontal axis, means on the table top which an implement is adapted to be attached for movement in the plane of the table top without limitation in direction to said plane. The aforesaid means is an elongate flexible cord entrained about a pulley rotatably mounted at the far edge of the table top so that a portion rests upon the table top and a portion hangs downwardly over the far edge, an implement holder attached to the end of the cord resting on the table top and means connected to the end of the cord hanging down from the far edge for yieldably loading the cord in a direction to retract the portion of the cord resting on the table top toward the top thereof. The means for loading the cord may be a weight or a spring. The table top is hingedly connected to a platform for angular movement relative thereto with respect to the horizontal and the platform is mounted to a pedestal for vertical mount and/or rotated about a vertical axis.

The invention will now be described in greater detail with reference to the accompanying drawings, wherein.

Figure 1:
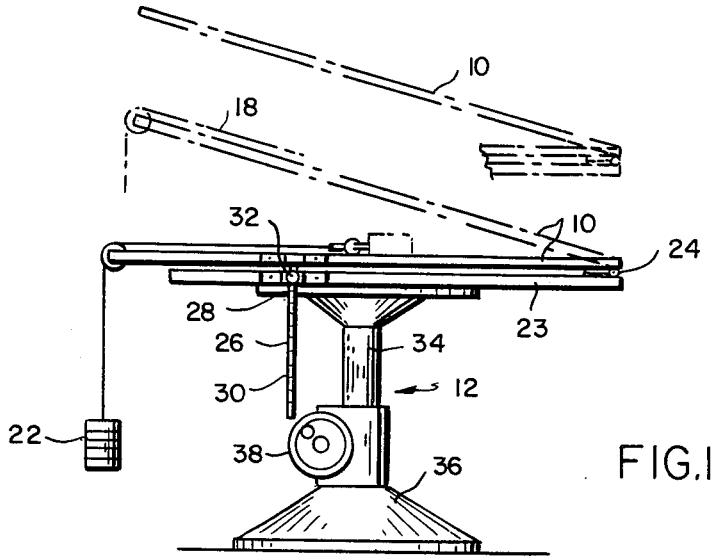
FIG. 1 is an elevation of the table of this invention with the table shown in horizontal and elevated positions and at different vertical heights.
Figure 2:
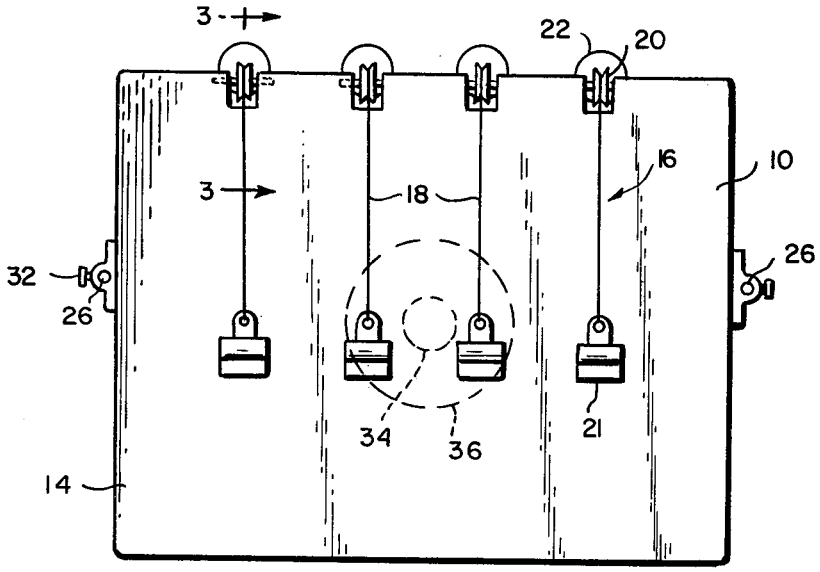
FIG. 2 is a plan view of the table perpendicular to its surface.
Figure 3:
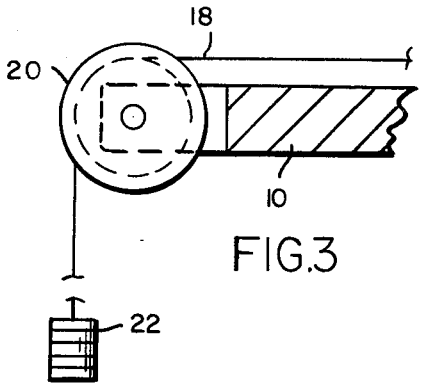
FIG. 3 is a fragmentary detail taken on the line 3—3 of FIG. 2.
Figure 4:
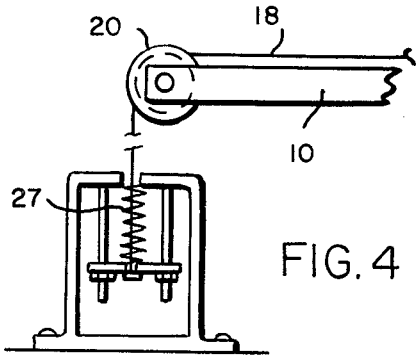
FIG. 4 is a fragmentary detail similar to FIG. 3 showing a spring substituted for the weights.

As shown, FIGS. 1 to 3, the structure comprises essentially a flat table top 10 mounted on a support 12 so that it may be moved from a horizontal position to an inclined position as shown in FIG. 1. The table top 10 is substantially rectangular and has a smooth planar work surface 14. In accordance with the invention, one or more means 16 are provided on the table top to which an implement may be attached for movement in the plane of the table top without limitation in direction in said plane. The means 16 comprises an elongate flexible cord 18, a portion of which rests on the surface of the table and a portion of which extends over the far or upper edge of the table over a pulley 20 rotatably mounted at the far or upper edge of the table. A work holder 21 is attached to the end of the cord resting on the table top and one or more weights 22 are attached to the portion of the cord hanging downwardly over the far or upper edge of the table. The effect of the weight is to require exertion of the part of the patient to pull an implement attached to the work holder 21 over the surface of the table top whether the latter is horizontal or at an angular position. The work holder 21 may be, for example, a simple paper clamp comprising a pair of spring jaws between which the implement which is to be used by the patient is clamped. A pencil, pen, crayon, punch, knife, and other such devices may be held by the holder. As time goes on and the patient becomes more adept and facile, the number of weights 22 may be increased to require greater exertion on his part. As shown, there are four such implement holders so that a number of implements may be available to the patient at any one time. An adjustable spring 27, FIG. 4, may be substituted for the weights 22.

While the table top can be used in a horizontal position and a certain amount of resistance to movement is afforded by the weighted cables, as previously explained, it is a temptation to the patient to lean on the table and thus lessen the effectiveness of the treatment and so it is more desirable to elevate the table angularly with respect to the horizontal and, as shown herein, this is achieved by mounting the table top 10 on a horizontally disposed platform 23 by means of a hinge 24 and providing at opposite sides of the platform elevating rods 26—26 which are pivotally connected at their upper ends to the underside of the table top and extend through slots 28—28 in the platform. These rods are conveniently marked off with divisions 30 to enable keeping track of the angular position of the table top relative to the platform. Thumbscrew 32 provides for locking the rods in any selected position.

The table may be used with beneficial results without loading the cords when the table top is set up at an angle to the horizontal since the patient must work against gravity when the table is so positioned to move an implement over the inclined surface. When used in this fashion, the cords 18 may be employed simply to suspend the implements and so the upper ends of the cords may be fixed to the upper or far edge of the table.

The platform 23 is mounted to the support 12 which comprises a stool 34, the lower end of which is supported for vertical movement in a base 36, for example, a base such as that employed for supporting a barber chair for vertical movement by means of a hand wheel 38. Vertical movement of the stool enables raising and lowering the table top so that a patient can use it either in a sitting or standing position. Rotation of the table about the vertical axis of the stool is also permitted by this construction and makes it convenient for adjusting the table top to the particular physical infirmity of the patient.

As thus designed, the structure is of relatively simple and inexpensive construction and yet it is adaptable to patients of varying capacities and to promote and encourage continued and persistent effort on the part of the patient.

It should be understood that the present disclosure is for the purpose of illustration only and includes all modifications or improvements which fall within the scope of the appended claims.

I claim:

1. Apparatus comprising in combination a support, a rigid, uniformly-flat tabletop defining a working surface, hinge means pivotally connecting one edge of the table top to the support for angular adjustment of its working surface about a horizontal axis to dispose said working surface in an inclined plane, a flexible cord supported in a manner to reduce frictional drag at the distal edge of the table for movement of a portion thereof around the distal edge toward the proximal edge, means connected to one end of the cord yieldably resisting movement of the cord toward the proximal edge of the table and clamp means attached to the other end of the cord for attaching an implement thereto to prevent the latter from slipping off the working surface of the tabletop when the tabletop is situated in an inclined position.

2. A work table according to claim 1 comprising means for adjustably changing the resistance to movement of said second-named means.

3. A structure according to claim 1 wherein a pulley is rotatably mounted at the distal edge of the table and the cable is entrained about the pulley with a portion resting on the surface of the table and a portion suspended over the distal edge and wherein the implement holder is attached to the portion of the cable resting on the table and wherein there is means yieldably loading the portion of the cable depending from the edge of the table.

4. A structure according to claim 3 wherein the last-named means is a weight.

5. A structure according to claim 3 wherein the last-named means is a spring.

6. Apparatus according to claim 1 wherein there is means for adjusting the angular position of the table top.

7. Apparatus according to claim 1 wherein there is means for adjusting the vertical height of the table top.

8. Apparatus according to claim 1 wherein the support includes a horizontally-disposed platform and the tabletop is hinged to the platform.

9. Apparatus according to claim 8 wherein a pedestal supports the platform for vertical adjustment and for rotation about a vertical axis.

10. Apparatus according to claim 1 comprising adjustable support members connecting the platform and tabletop for adjusting the angular position of the tabletop relative to the platform.

* * * * *